United States Patent [19]

Ketterer et al.

[11] 4,086,861

[45] May 2, 1978

[54] ELECTRO-MECHANICAL ACTUATOR

[75] Inventors: Stanley Joseph Ketterer, Jamesburg; Kenneth Douglas Adams, Madison, both of N.J.

[73] Assignee: The Singer Company, New York, N.Y.

[21] Appl. No.: 769,352

[22] Filed: Feb. 16, 1977

[51] Int. Cl.[2] ..... D05B 3/02

[52] U.S. Cl. ..... 112/158 E

[58] Field of Search ..... 112/158 E, 158 R, 158 A, 112/158 D; 74/54, 56

[56] References Cited

U.S. PATENT DOCUMENTS

| | | | |
|---|---|---|---|
| 3,699,910 | 10/1972 | Urciola et al. | 112/158 A |
| 3,812,729 | 5/1974 | Ketterer | 74/56 |
| 3,872,808 | 3/1975 | Wurst | 112/158 E |
| 4,011,432 | 3/1977 | Skogward | 74/56 X |

*Primary Examiner*—Werner H. Schroeder
*Assistant Examiner*—Peter Nerbun
*Attorney, Agent, or Firm*—Julian Falk; Robert E. Smith; Edward L. Bell

[57] ABSTRACT

An electro-mechanical actuator for sewing machines which allows settings to be made electrically and then acts upon such settings mechanically using the power from the sewing machine drive. This electro-mechanical actuator utilizes the full cycle of a sewing operation for the setting and positioning of the controlled function.

4 Claims, 3 Drawing Figures

ELECTRO-MECHANICAL ACTUATOR

BACKGROUND OF THE INVENTION

In order to control the stitch forming instrumentalities of a sewing machine electronically, control systems have been devised which upon receipt of a signal activate an electric solenoid or actuator to adjust, for example, the needle jogging mechanism or the material feed. In one type of known control system of this character the signal receiving unit performs the actual adjustment of the machine functions, and thus very high power requirements are imposed on the control system. Moreover, since all of the actual adjustment must be completed during a half cycle of needle reciprocation, for instance needle jogging must be accomplished while the needle is out of the fabric, the speed of the sewing machine may have to be limited.

SUMMARY OF THE INVENTION

The object of this invention is to provide an electromechanical actuator which isolates the signal receiving unit from the controlled mechanism. This object is achieved by having this signal receiving unit control a stop, whereupon the sewing machine drive is used to re-position the controlled mechanism up to the limits of the stop. In order to utilize the full cycle of the sewing machine operation, this invention locks the controlled mechanism in position duing one-half of this cycle allowing the receiving unit to re-position the stop in accordance with the next input during this time.

DESCRIPTION OF THE PREFERRED EMBODIMENT

Figure 1:
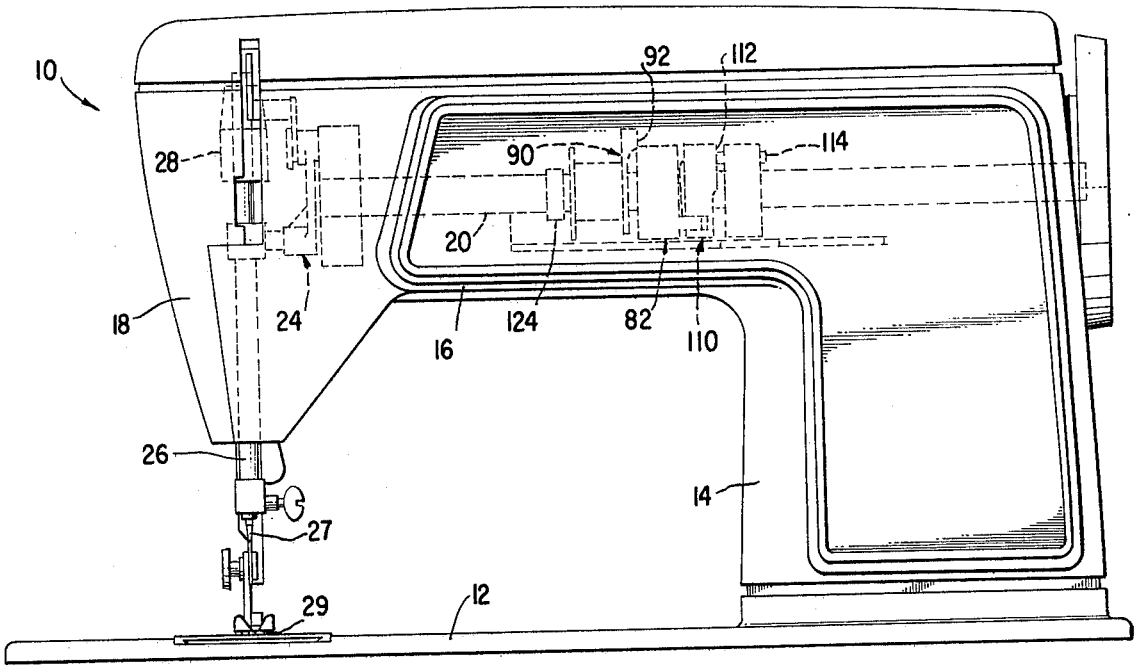
FIG. 1 is a front elevation of a sewing machine in which the invention is incorporated.
Figure 3:
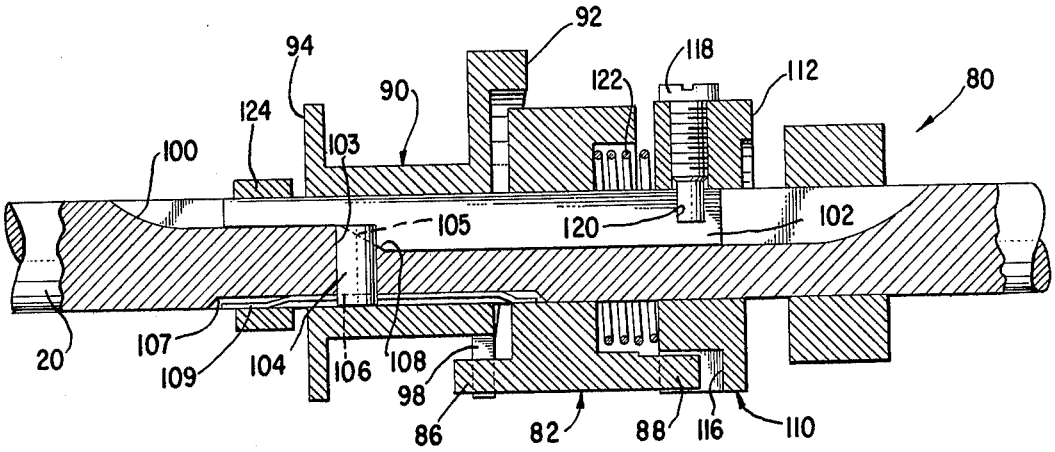
FIG. 3 is a cross-sectional view of the sewing machine main shaft with a portion of the invention attached thereto.
Figure 2:
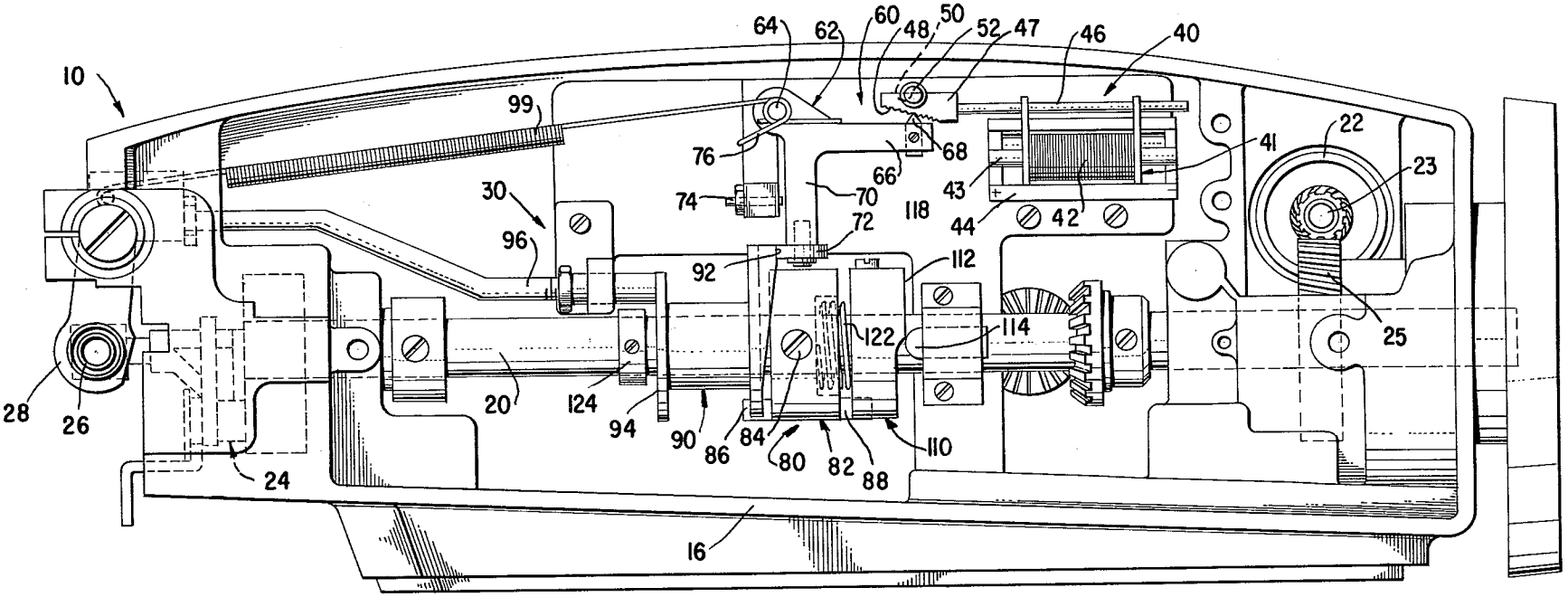
FIG. 2 is a top elevation of the bracket arm, with the cover removed showing the invention in use.

Referring to the drawings for a detailed description of the invention, a zig-zag sewing machine is generally referred to by the reference number 10. The sewing machine 10 includes a bed 12, a hollow standard 14 rising from the bed 12, a bracket arm 16 extending from the hollow standard 14 and terminating in a sewing head 18 which overhangs the bed 12. Journaled in the bracket arm 16 is a main shaft 20. A drive motor 22 is preferably carried within the rear portion of the hollow standard 14 and connected by a worm 23 and wheel 25 to the main shaft.

Within the sewing head 18, the main shaft 20 carries a conventional crank mechanism 24 for imparting endwise reciprocatory motion to a needle bar 26 to the end of which a needle 27 is clamped. To provide for zig-zag stitching, the needle bar 26 is endwise slidable in a gate 28 to which is imparted lateral jogging motion by the electro-mechanical actuator 30 of this invention.

Within the bed 12 is a conventional drop-feed, as illustrated by feed dog 29, having adjusting means for varying the amount and direction of feed. The electromechanical actuator 30 of this invention, may also be used to control the feed adjusting means.

The electro-mechanical actuator 30 is composed of three sections; an electro-mechanical setting mechanism 40, a mechanical sensor mechanism 60 and a mechanical actuator 80 for positioning a sewing machine instrumentality. In this embodiment, the setting mechanism 40 includes a galvanometer 41. The galvanometer 41 comprises an electrical coil 42, slidably disposed on a guide 43, which, when excited, moves linearly in a magnetic field produced by a magnetized frame 44, to a position dependent on the magnitude of the excitation. A rod 46 attaches the galvanometer coil 42 to a slider 47. The slider 47 is formed with a step ramp 48 on one side thereof and rests in a slot 50 formed in a support 52 which is rigidly attached to the bracket arm 16 of the sewing machine 10. The slider 47 with the step ramp 48 thereon along with the support 52 form a movable stop for the sensor mechanism 60.

Although, in this embodiment, a galvanometer 41 is being used to position the slider 47, it should be noted that other electro mechanical devices, for example, a stepper motor, may be used in place of the galvanometer 41 for positioning the slider 47.

The sensor mechanism 60 comprises an L-shaped bracket 62 pivotally mounted at its mid-point on a support pin 64. Attached to a first arm 66 of the bracket 62 is a follower probe 68 for engaging the step ramp 48. Attached to the second arm 70 of the bracket 62 is a roller cam follower 72 for tracking the actuating cam 90 of the actuator mechanism 80. Adjacent to said second arm 70 is mounted a stop 74 towards which the bracket 62 is pivotally biased by a spring 76.

The actuator mechanism 80 is primarily disposed on the main shaft 20. The main elements of the mechanism 80 are a driver collar 82, an actuator cam 90, and a locking cam 110. The driver collar 82 is fixed to the main shaft 20 by a set screw 84 and applies rotation, in conjunction with the main shaft 20, to the actuator cam 90 and the locking cam 110 by means of two tabs 86 and 88 extending axially therefrom. It should be noted that the actuator cam 90 and the locking cam 110 are free to move axially with respect to the main drive 20.

The actuator cam 90 is formed with a partial surface cam 92 on one face for engaging the roller cam follower 72 of the bracket 62 and a flat flange 94 on the other face for engaging a rod 96 connected to the needle bar gate 28. A notch 98 is provided for receiving a tab 86 of the driver collar 82. The needle bar gate 28 is biased by a spring 99 to maintain engagement of the rod 96 with the flange 94.

For locking the actuator cam 90 in position on the main shaft 20, the main shaft 20 is formed with a groove 100 for accommodating a sliding key 102. Intersecting the groove 100 is a hole 103 which emanates from the opposite side of the main drive shaft 20. A locking plug 104 is slidably disposed within the hole 103. The hole 103 is located on the main drive 20 in such a position that the locking plug 104 will always be able to engage the actuator cam 90. The locking plug 104 is formed with a transverse beveled groove 105 for engaging the sliding key 102 and is forced into engagement with the actuator cam 90 by a ramp 108 formed in the key 102. A groove 107 is also formed in the main shaft 20 for accommodating a spring 109 which engages a transverse slot 106 in the locking plug 104 and maintains engagement of the locking plug 104 with the sliding key 102.

The locking cam 110 is formed with a surface cam 112 for engaging a stationary cam follower 114. A notch 116 is provided for engaging tab 88 on the driver collar 82. It should be noted that when the main shaft 20 imparts rotation to the locking cam 110 through the driver collar 82, the stationary cam follower 114 forces axial motion to the locking cam 110. This axial motion is transferred to the sliding key 102 by means of a set screw 118 in the locking cam 110 which engages a notch 120 in the sliding key 102. Biasing means, such as coil spring 122, maintains the engagement of the cam surface 112 with the cam follower 114. A collar 124 is provided for retaining the sliding key 102 in the groove 100.

The notches 98 and 116 on the actuator cam 90 and the locking cam 110, respectively, along with the tabs 86 and 88 on the locking collar 82 are so sized as to accommodate any sliding motion of the cams 90 and 110.

In operation, as the main drive 20 rotates, the surface cam 92 engages the roller cam follower 72 pivoting the bracket 62 until the follower probe 68 engages the step ramp 48 of the slider 47. Since this arrests any further pivoting of the bracket 62, the roller cam follower 72 then necessarily forces an axial movement of the actuator cam 90 while the roller cam follower 72 is engaging the surface cam 92. This axial movement is transferred to the needle bar gate 28 by the rod 96 abutting the flange 94 on the actuator cam 90.

Prior to the roller cam follower 72 leaving the partial surface cam 92, the cam follower 114 engages the surface cam 112 of the locking cam 110 which then moves the ramp 108 on the sliding key 102 against the locking plug 104 moving the locking plug 104 radially outward to arrest further axial movement of the actuator cam 90, after the roller cam follower 72 leaves the partial surface cam 92. At this point, spring 76 pivots the bracket 62 against the stop 74 and, in so doing, removes the follower probe 68 from the step ramp 48 freeing the galvanometer 41 so that it may reposition the slider 47.

Having thus set forth the nature of the invention, what we herein claim is:

1. In a zig-zag sewing machine having a main drive, stitch forming instrumentalities including a needle bar capable of lateral jogging motion and a variable feed, and means for generating an electrical signal which varies in proportion to desired movements of said stitch forming instrumentalities, an electro-mechanical actuator comprising a single movable stop; a means for positioning said movable stop in proportion to the magnitude of said electrical signal; sensing means for intermittently identifying the position of said movable stop; actuating means slidably disposed on said sewing machine main drive, said actuating means being driven in rotation by said sewing machine main drive; actuator positioning means for slidably positioning said actuating means on said main drive in proportion to the position of said movable stop identified by said sensing means; means for intermittently arresting the sliding motion of said actuating means after being positioned by said actuator positioning means; and means attached to said actuating means for transferring said sliding motion of said actuating means to said stitch forming instrumentalities.

2. An electro-mechanical actuator as set forth in claim 1 wherein said movable stop is a step ramp and said means for positioning said movable stop is a galvanometer.

3. An electro-mechanical actuator as set forth in claim 2 wherein said actuating means comprises an annular ring slidably disposed on said main drive having a surface cam formed in one face thereof.

4. An electro-mechanical actuator as set forth in claim 3 wherein said sensing means and said actuator positioning means comprise a bracket pivotally mounted at the midpoint thereof to said sewing machine, having a probe on a first end for intermittently engaging said step ramp, and a roller cam follower on a second end for engaging said surface cam on said actuating means, whereby when said main drive is rotated, said roller cam follower engages said surface cam which then pivots said bracket until said probe engages said step ramp, whereupon said roller cam follower, acting upon said surface cam, will slide said actuating means along said main drive.

* * * * *